US007105077B2

(12) United States Patent
Onikubo et al.

(10) Patent No.: US 7,105,077 B2
(45) Date of Patent: Sep. 12, 2006

(54) PRESS FELT FOR PAPERMAKING AND MANUFACTURING METHOD

(75) Inventors: Akira Onikubo, Tokyo (JP); Hiroyuki Oda, Tokyo (JP); Yasuhiko Kobayashi, Tokyo (JP); Masufumi Shimodaira, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 91 days.

(21) Appl. No.: 10/764,847

(22) Filed: Jan. 26, 2004

(65) Prior Publication Data

US 2004/0173274 A1 Sep. 9, 2004

(30) Foreign Application Priority Data

Jan. 28, 2003 (JP) ..... 2003-019362

(51) Int. Cl.

| | |
|---|---|
| ***D21F 7/08*** | (2006.01) |
| ***B32B 5/06*** | (2006.01) |
| ***B32B 5/22*** | (2006.01) |
| *D21F 3/00* | (2006.01) |

(52) U.S. Cl. ..... 162/358.2; 162/900; 442/271; 442/318

(58) Field of Classification Search ..... 162/116, 162/117, 348, 358.2, 900, 902, 903, 361, 162/362; 139/383 A, 425 A; 442/270–274, 442/304, 318, 319; 28/110, 142
See application file for complete search history.

(56) References Cited

U.S. PATENT DOCUMENTS

| | | | | |
|---|---|---|---|---|
| 4,761,329 A | * | 8/1988 | Halker et al. | 428/222 |
| 4,806,413 A | * | 2/1989 | Penven | 428/222 |
| 4,856,562 A | * | 8/1989 | Dufour | 139/383 A |
| 5,360,656 A | | 11/1994 | Rexfelt et al. | |
| 5,945,357 A | * | 8/1999 | Quigley | 442/189 |
| 6,479,414 B1 | * | 11/2002 | Hauer | 442/326 |
| 6,648,147 B1 | * | 11/2003 | Lydon et al. | 210/490 |
| 6,811,849 B1 | * | 11/2004 | Best | 428/58 |

FOREIGN PATENT DOCUMENTS

| | | | |
|---|---|---|---|
| EP | 1 045 066 A2 | | 4/2000 |
| FR | 2 727 442 | | 11/1994 |
| FR | 2 727 442 | * | 5/1996 |
| JP | 02-229247 | * | 9/1990 |
| JP | 2514509 | | 8/1996 |
| JP | 504167-2001 | | 3/2001 |
| JP | 2001-234456 | * | 8/2001 |

* cited by examiner

*Primary Examiner*—Eric Hug
(74) *Attorney, Agent, or Firm*—Howson & Howson

(57) ABSTRACT

A press felt for papermaking comprises a base body, a fibrous assembly, and a three-dimensional knitted fabric within the interior of the felt. The base body and the knitted fabric may be in contact, or, for improved adhesion between the base body and the knitted fabric, a fibrous assembly may be disposed between the base body and the knitted fabric. Excellent compression recoverability and sustainability may be obtained.

8 Claims, 20 Drawing Sheets

FIG. 16

| | Experiment 1 | | | Experiment 2 | Experiment 3 |
|---|---|---|---|---|---|
| | compression recoverability | | sustainability | evaluation of wet paper web | connection strength between base body and three-dimensional knitting |
| | beginning | ending | | | |
| Example 1 | 5 | 4 | 4 | ○ | 3 |
| Example 2 | 4 | 4 | 5 | ○ | 2.5 |
| Example 3 | 4.5 | 4 | 4.5 | ○ | 3 |
| Comparative Example 1 | 3 | 2 | 3 | △ | - |
| Comparative Example 2 | 2 | 2 | 4 | △ | 3 |

PRESS FELT FOR PAPERMAKING AND MANUFACTURING METHOD

FIELD OF THE INVENTION

This invention relates to a press felt for papermaking, used in a papermaking machine (hereinafter, referred to as a "felt").

BACKGROUND OF THE INVENTION

As generally known, a felt is used to draw water from a wet paper web in the press part of a papermaking machine.

In the press part PP of a papermaking machine shown in FIG. 17, water is removed from a wet paper web WW proceeding between a pair of press rolls PR, using a single felt 10A. In the apparatus shown in FIG. 18, water is removed from a wet paper web WW pinched between two felts 10A in the press part PP. In the apparatus shown in FIG. 19, in which the press part PP comprises a press roll PR and a press shoe PS with a resin belt SB therebetween, water is removed from a wet paper web WW pinched between two felts 10A.

In each of the cases illustrated in FIGS. 17–19, the felt 10A is driven by the rotating press roll or rolls PR, and is compressed in the press part PP.

The general structure of a felt 10A is illustrated in FIG. 20. The felt 10A is endless, and comprises a base body 20A, and a fibrous assembly 30A connected to the base body 20A. The base body, which may be a woven fabric, imparts strength to the felt. The felt 10A enters into the press part PP in contact with a wet paper web, and is compressed as pressure is applied in the press part PP. The felt recovers its pre-compression condition after it moves out of the press part.

Compressibility and recoverability are necessary in a felt because, if the felt were not compressed when entering the press part of the papermaking machine, the wet paper web would be torn as a result of the pressure applied by the press rolls. Moreover, the speed of the felt and the press pressure have both increased as a result of developments in papermaking machinery in recent years. Accordingly, the conditions to which the felts are subject have become more severe, and it has been a challenge to maintain the compression-recovery function, and thereby produce a felt having a satisfactory useful life. Thus, various proposals for structures which may maintain compressibility and recoverability have been made.

One such proposal, described in Japanese Utility Model Registration No. 2514509, is a felt comprising a base fabric woven of thread, and a staple fiber integrated by needle punching with the base fabric. This felt uses fibers which exhibit elasticity as the threads of the base fabric or as the staple fiber. Fibers comprising a polyamide block copolymer which has hard segments composed of polyamide components and soft segments composed of polyether components, may be used as the elastic fibers.

On the other hand, for the purpose of improving compressibility and recoverability, a different felt structure, which does not comprise a base fabric and a staple fiber, has been proposed in Unexamined Japanese Patent Publication No. 504167/2001. In this felt, as shown in FIG. 21, a base body 20A comprises not just a woven fabric 20A1, but also a thermoplastic resin, mesh-shaped, compact sheet 20A2 and a multi-filament reinforcing yarn 20A3, the filaments being surrounded by a synthetic rubber material.

In the felt made in accordance with the first of the above-described proposals, recoverability diminished over repeated passage through the press part, due to the crushing of air voids formed between staple fibers.

In the case of the structure shown in FIG. 21, where an elastic structure, comprising sheet 20A2 and a reinforcement yarn 20A3, is used for improving the sustainability of the felt's thickness, the elastic structure is not compressed easily. As a result, its compression recoverability is not very different from that of the felt shown in FIG. 20, which has no elastic structure.

In view of the above problems, the object of this invention is to provide a felt that exhibits excellent compression recoverability, and the ability to maintain a high level of compression recoverability over a long time. It is also an object of the invention to provide a manufacturing method for such a felt.

SUMMARY OF THE INVENTION

The press felt of the invention has a wet paper web contacting surface and a machine contacting surface, and comprises a base body, a fibrous assembly, and a three-dimensional knitted fabric, comprising two overlying layers of fabric connected to each other by connecting fibers, which are preferably monofilament fibers. The three-dimensional knitted fabric is incorporated within the felt at a distance from both the wet paper web contacting surface and the machine contacting surface.

The three-dimensional knitted fabric may be provided on the wet paper web contacting surface side, or on the machine contacting side, relative to the base body.

In one preferred embodiment, the three-dimensional knitted fabric is provided between two base bodies.

The knitted fabric may be in direct contact with the base body or bodies. However, for improved adhesion, a fibrous assembly is provided between the three-dimensional knitted fabric and a base body.

The three-dimensional knitted fabric and the fibrous assembly may be adhesively bonded to each other or integrated by needle punching.

The three-dimensional knitted fabric may be formed by helically winding a three-dimensional knitted fabric having a width smaller than that of the press felt, by winding a series of three-dimensional knitted fabrics coaxially in side-by-side relationship, each having a width smaller than that of the press felt, or by winding one three-dimensional knitted fabric having the same width as that of the press felt.

According to the invention, a felt, having excellent compression recoverability and the ability to maintain compression recoverability at high level for a long time, may be achieved by providing within the felt a layer of three-dimensional knitted fabric made by connecting a pair of fabrics by connecting fibers.

BRIEF DESCRIPTION OF THE DRAWINGS

FIG. 16 is a chart showing results of evaluations conducted using an apparatus of FIG. 15;

DETAILED DESCRIPTION OF THE PREFERRED EMBODIMENTS

Figure 6:
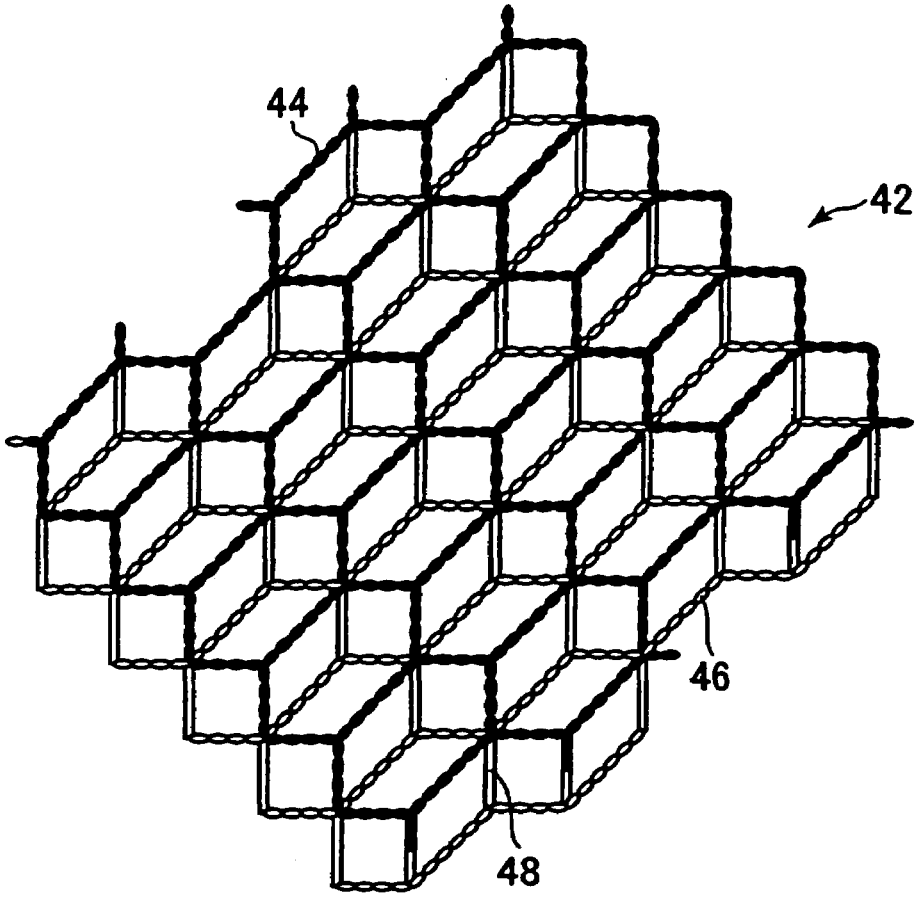
FIG. 6 PRIOR ART
FIG. 6 is a perspective view of a three-dimensional knitted fabric.
Figure 7:
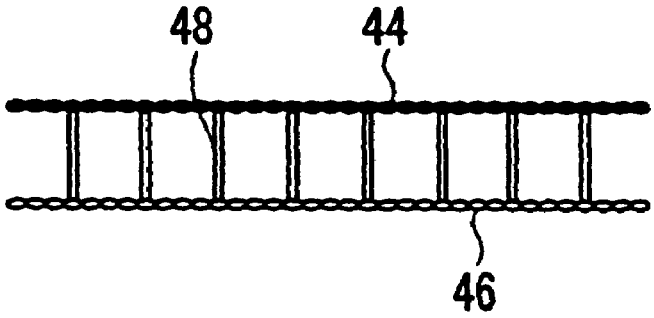
FIG. 7 PRIOR ART
FIG. 7 is a cross-sectional view of a three-dimensional knitted fabric.

As shown in FIGS. 6 and 7, a three-dimensional knitted fabric 42 comprises a first fabric 44, illustrated by connected black dots, a second fabric 46, illustrated by connected white dots, and connecting fibers 48, which connect the first fabric and the second fabric.

Figure 8:
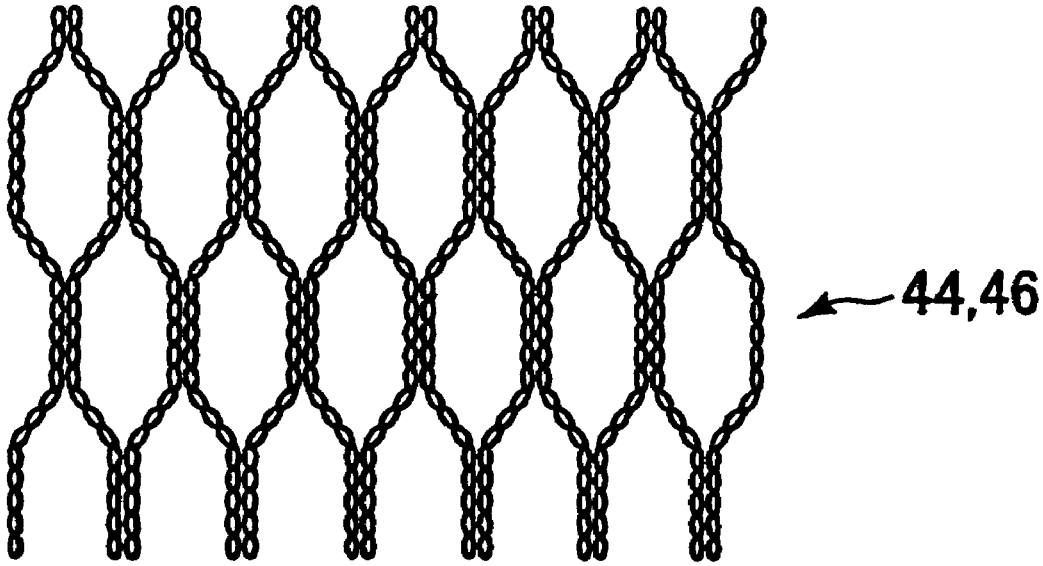
FIG. 8 PRIOR ART
FIG. 8 is a plan view of a three-dimensional knitted fabric.
Figure 9:
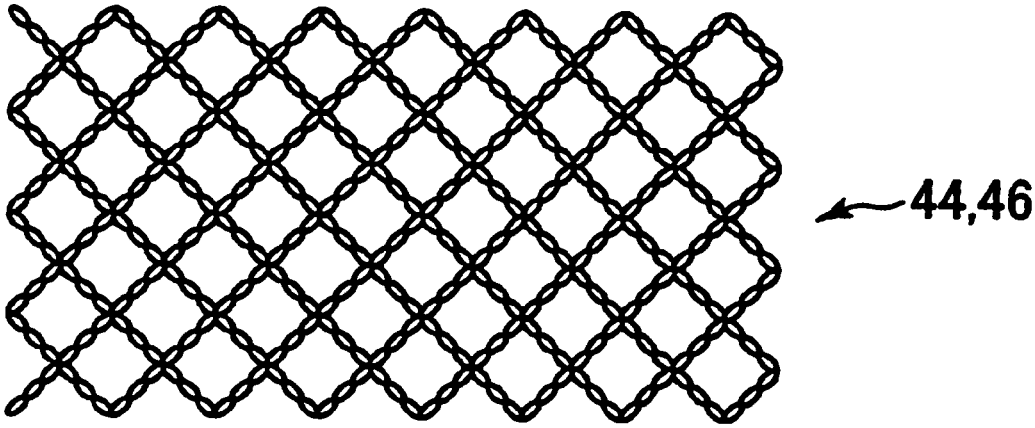
FIG. 9 PRIOR ART
FIG. 9 is a plan view of another three-dimensional knitted fabric.

Any of the well-known structures described in Unexamined Japanese Patent Publications No. 31241/1986, No. 229247/1990 and No. 234456/2001 etc. may be used for the three-dimensional knitted fabric 42. Thus, the hexagonal mesh shown in FIG. 8, the diamond mesh shown in FIG. 9, or any of variety of other known structures, may be used for the first or the second fabric, as appropriate.

Figure 10:
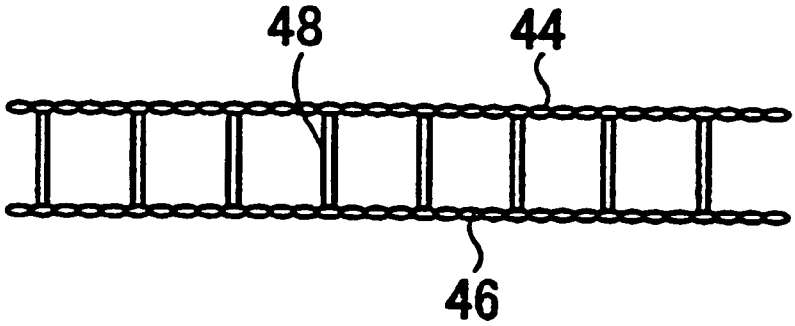
FIG. 10 PRIOR ART
FIG. 10 is a cross-sectional view of a three-dimensional knitted fabric.
Figure 11:
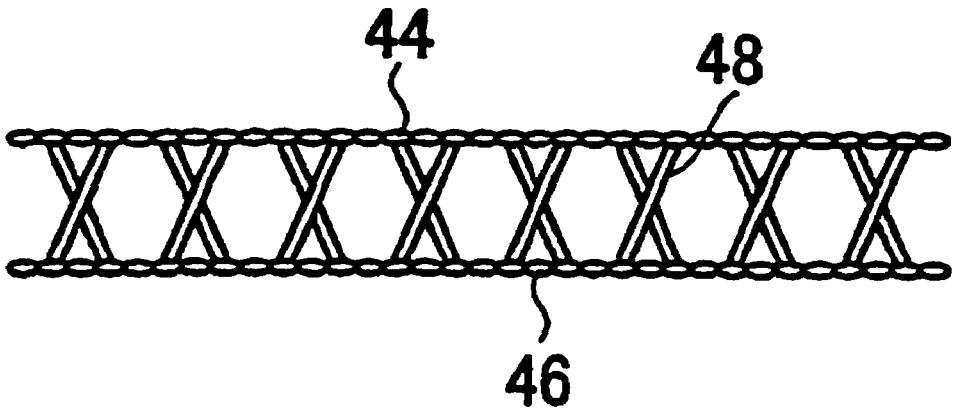
FIG. 11 PRIOR ART
FIG. 11 is a cross-sectional view of another three-dimensional knitted fabric.

Furthermore, various structures are available for the connecting fibers. For example, a structure, as shown in FIG. 10, in which the first and second fabrics are connected by approximately parallel connecting fibers 48, may be used. Alternatively, a structure, as shown in FIG. 11, in which the connecting fibers 48 intersect, may be used.

A compression recovery effect which is sustained over a long time can be achieved by providing, inside the felt, a layer 40 of the three-dimensional knitted fabric. The connecting fibers 48, which extend in the direction of the thickness of the three-dimensional knitted fabric, support the first and the second fabrics 44, 46. After the three-dimensional knitted fabric 42 is compressed, and the load causing the compression is removed, the connecting fibers 48 recover their original form in the thickness direction, and therefore the felt exhibits excellent compression recoverability.

Where the proportion of the felt structure occupied by the layer 40 of three-dimensional knitted fabric is relatively high, the felt as a whole exhibits significantly better compression recoverability compared to that of a conventional felt structure. Here, a nylon monofilament having high flex fatigue resistance is suitable for the connecting fibers 48. Preferably its fineness is in the range from 10 to 500 dtex.

In addition, the basis weight of the three-dimensional knitted fabric should be in the range from 100 to 800 g/m$^2$, and preferably in the range from 300 to 600 g/m$^2$.

The distribution and formation of a layer 40 of a specific three-dimensional knitted fabric for a felt will be explained with reference to FIG. 1(*a*)–FIG. 5.

A felt 10 according to the invention comprises a base body 20, a fibrous assembly 30, and a layer 40 of a three-dimensional knitted fabric.

The felt 10 has a wet paper web contact surface 11, and a machine contact surface 12, and the various structures are selected appropriately for distribution and formation of the layer 40 of the three-dimensional knitted fabric.

Figure 1:
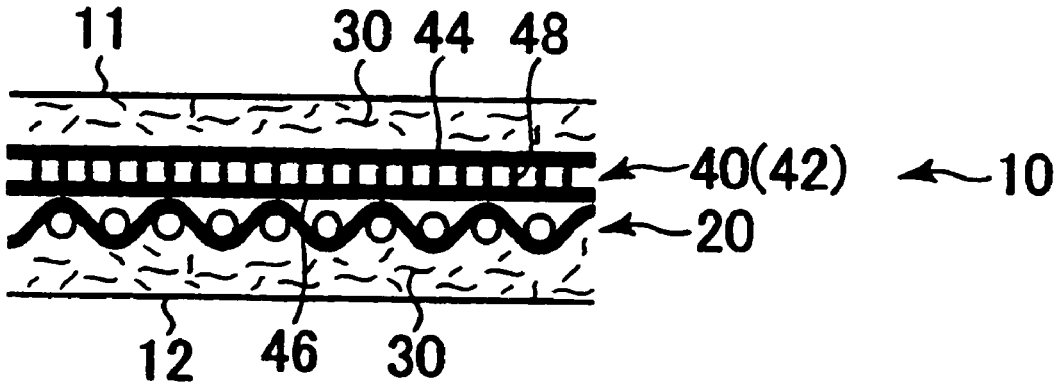
FIGS. 1(*a*) and 1(*b*) are schematic sectional views illustrating the distribution and formation of a three-dimensional knitted fabric of a felt according to the invention.
Figure 1:
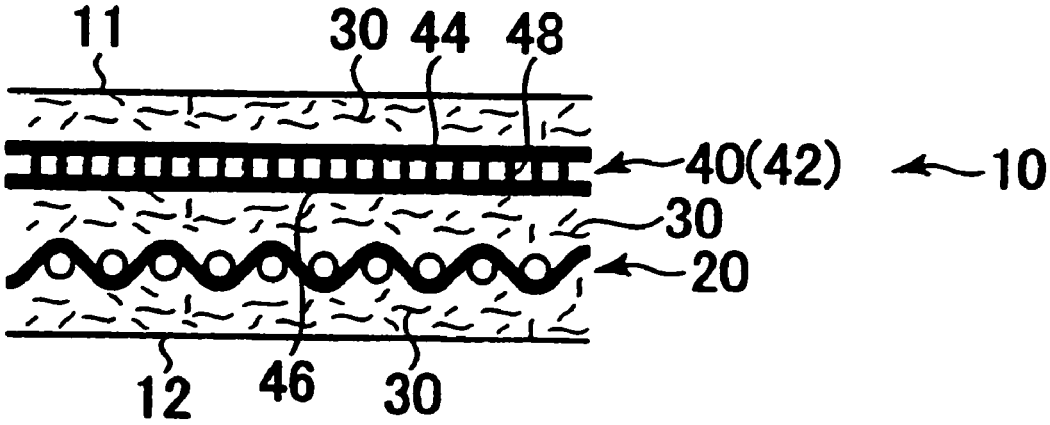

For example, as shown in FIGS. 1(*a*) and 1(*b*), a layer 40 of three-dimensional knitted fabric may be provided between a base body 20 and the wet paper web contact surface 11. The base body 20 and the layer 40 of the three-dimensional knitted fabric may be in contact with each other as shown in FIG. 1(*a*), or, alternatively, a fibrous assembly 30 may be situated between the base body 20 and the layer 40 of the three-dimensional knitted fabric as shown in FIG. 1(*b*).

Figure 2:
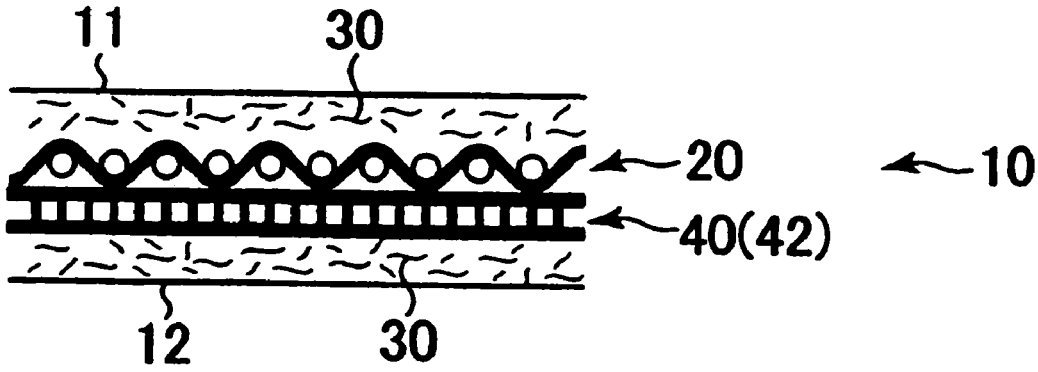
FIGS. 2(*a*) and 2(*b*) are schematic sectional views illustrating the distribution and formation of a three-dimensional knitted fabric of another felt according to the invention.
Figure 2:
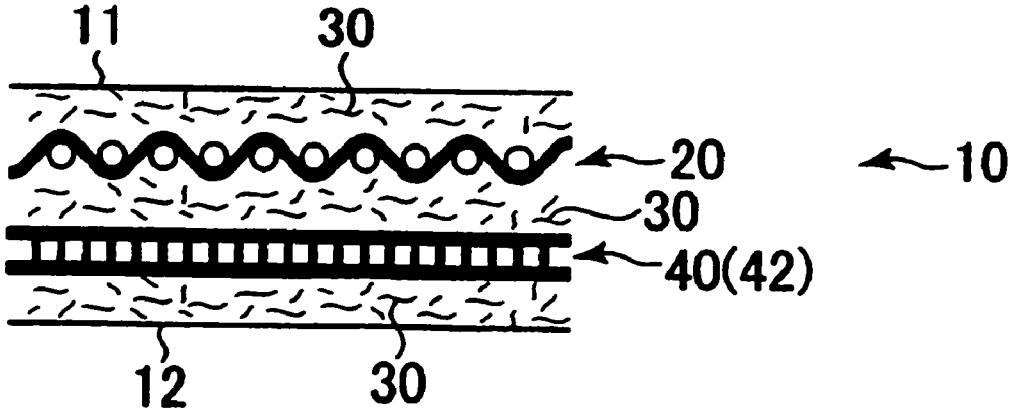

Alternatively the layer 40 of three-dimensional knitted fabric may be provided between a base body 20 and the machine contact surface 12 as shown in FIGS. 2(*a*) and 2(*b*) is this case, the base body 20 and the layer 40 of three-dimensional knitted fabric may be in contact with each other as shown in FIG. 2(*a*), or alternatively, a fibrous assembly 30 may be situated between the base body 20 and the layer 40 as shown in FIG. 2(*b*).

As a further alternative, not illustrated, the layer of three-dimensional knitted fabric may be provided in a felt which has two base bodies. As in FIG. 1(*a*)–FIG. 2(*b*), the three-dimensional knitted fabric may provided between the wet paper web contact surface and the base body closest to the wet paper web contact surface, or between the machine contact surface and the base body closest to the machine contact surface. Moreover, the knitted fabric may be either in direct contact with a base knotted or separated from the base body by an intermediate fibrous assembly as shown in FIGS. 1(*b*) and 2(*b*).

Figure 3:
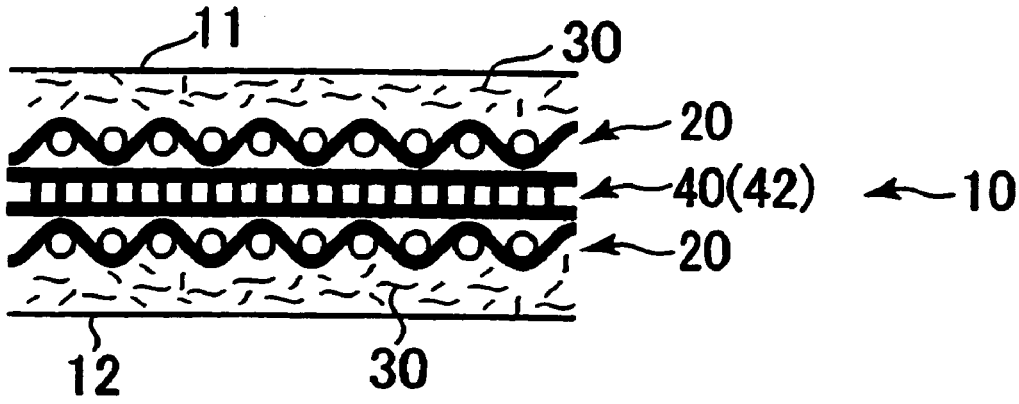
FIGS. 3(*a*)–3(*d*) are schematic sectional views illustrating the distribution and formation of a three-dimensional knitted fabric of still another felt according to the invention.
Figure 3:
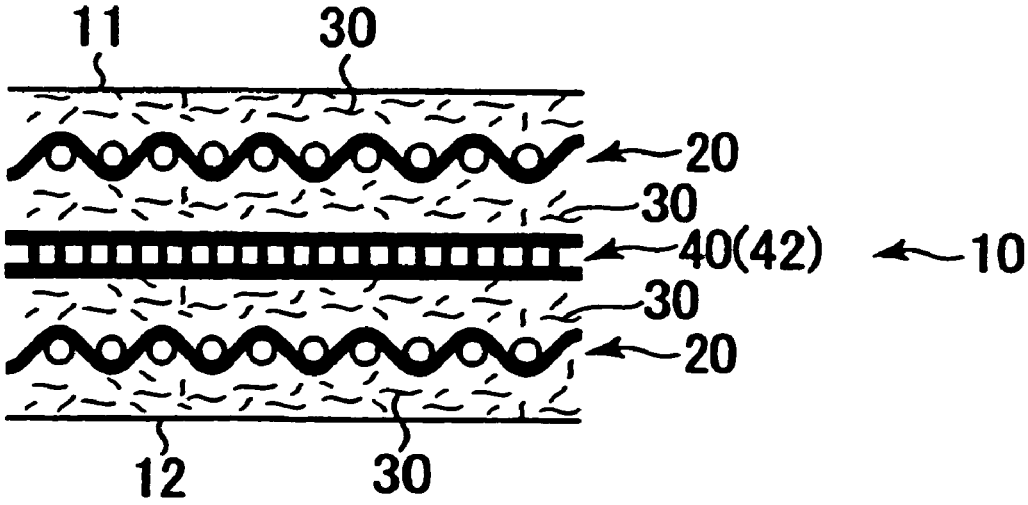
Figure 3:
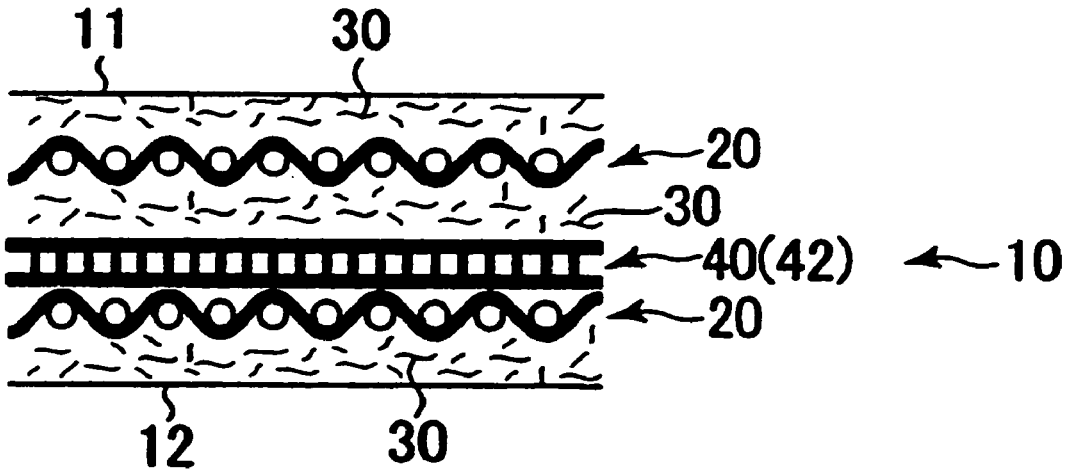
Figure 3:
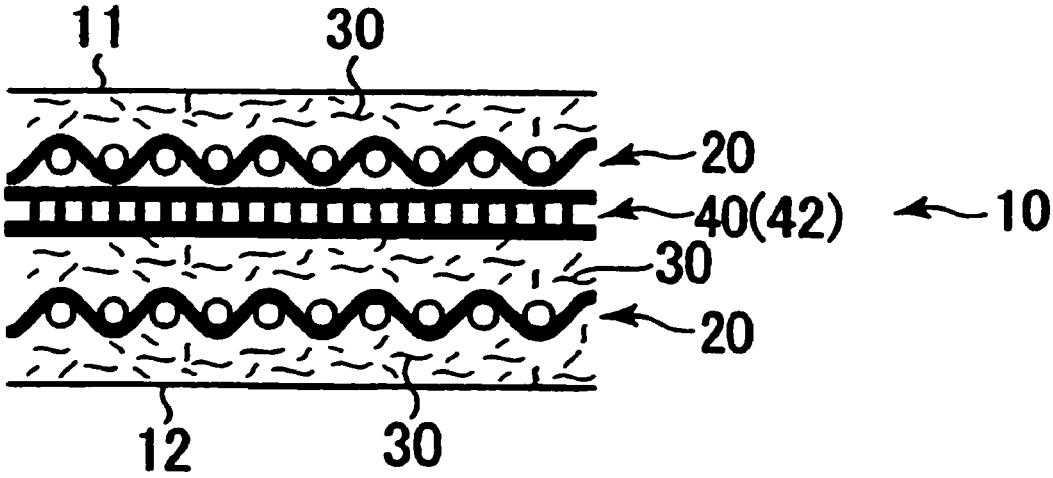

On the other hand, a structure shown in FIGS. 3(*a*)–3(*d*) may be adopted, in which the layer 40 of three-dimensional knitted fabric is provided between two base bodies 20.

As shown in FIG. 3(*a*), both base bodies 20 may be in contact with the layer 40. On the other hand, as shown in FIG. 3(*b*), it is possible fibrous assemblies 30 may be provided between each of the base bodies 20 and the layer 40 of three-dimensional knitted fabric.

Furthermore, as shown in FIG. 3(*c*), it is also possible to locate the layer 40 of three-dimensional knitted fabric so that it is in contact with the base body 20 nearest the machine contact side 12, but separated from the other base body by a fibrous assembly 30. Conversely, sa shown in FIG. 3(*d*), it is also possible to locate the layer 40 of three-dimensional knitted fabric so that it is in contact with the base body nearest the wet web contact side 11, but separated from the other base body by a fibrous assembly 30.

Figure 4:
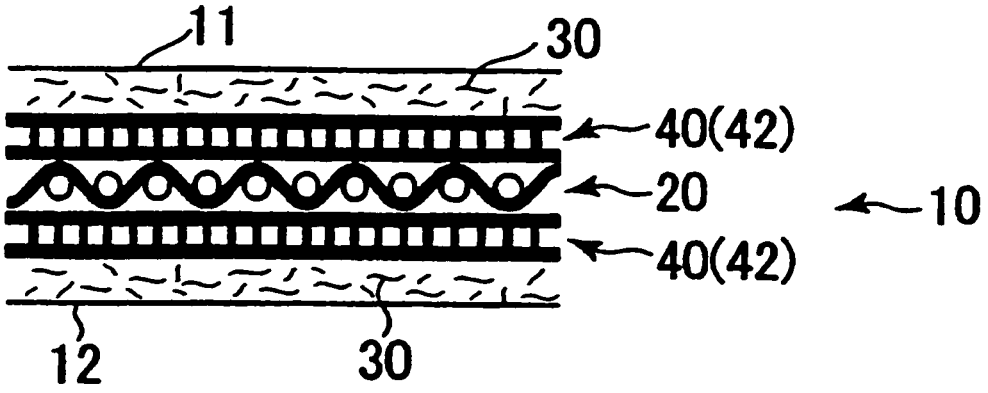
FIGS. 4(*a*)–4(*d*) are schematic sectional views illustrating the distribution and formation of a three-dimensional knitted fabric of still another felt according to the invention.
Figure 4:
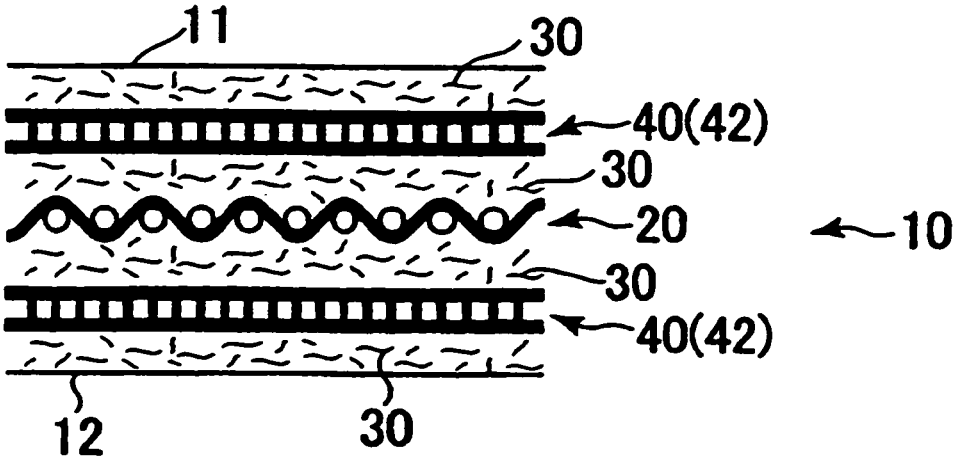
Figure 4:
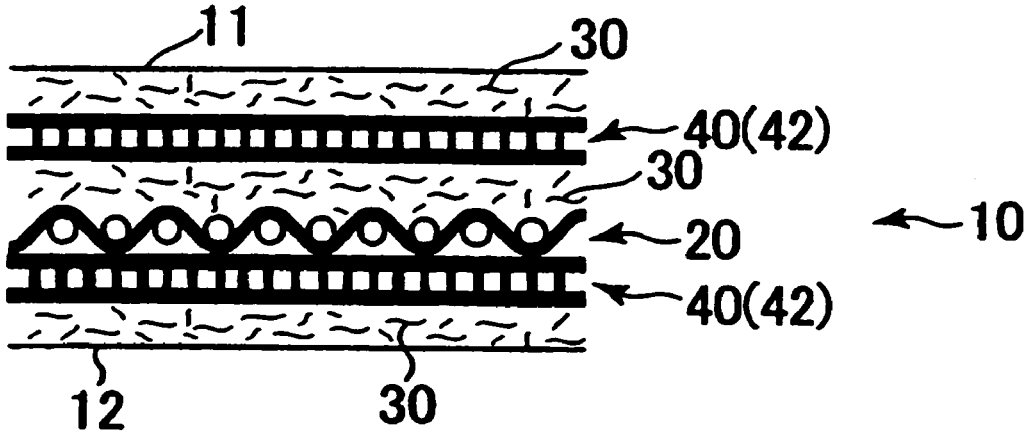
Figure 4:
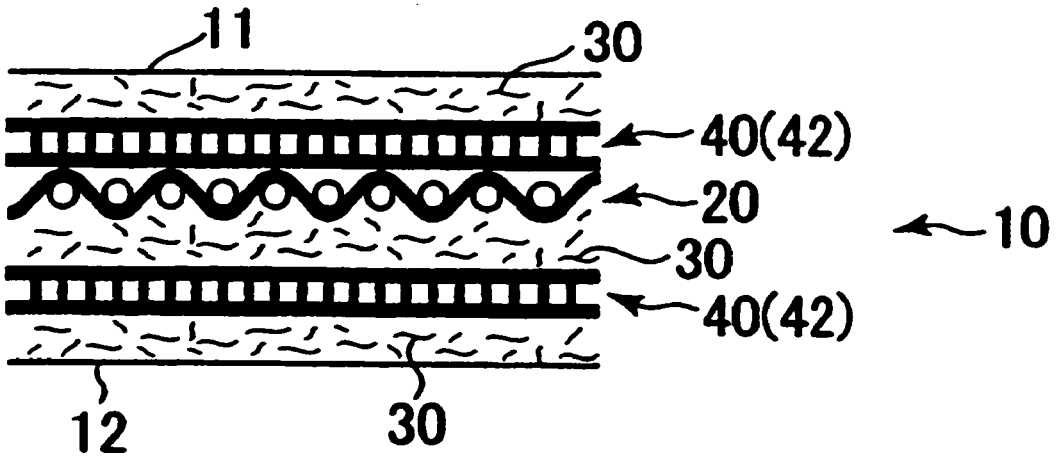

In still another embodiment, as shown in FIGS. 4(*a*)–4(*d*), two layers of three-dimensional knitted fabric may be provided on opposite sides of a base body 20, one such fabric layer 40 being between the base body and the wet paper web contact surface 11, and the other being between the base body 20 and the machine contact surface 12.

As shown in FIG. 4(*a*), both of the layers 40 of three-dimensional knitted fabric may be in contact with the base body 20. On the other hand, as shown in FIG. 4(*b*), fibrous assemblies 30 may be provided between the base body 20 and each of the layers 40 of three-dimensional knitted fabric.

Furthermore, as shown in FIG. 4(*c*), the base body can be in contact with the knitted layer 40 nearest the machine contact side 12, but separated from the other knitted layer by a fibrous assembly 30. Conversely, as shown in FIG. 4(*d*), the base body can be in contact with the knitted layer 40 nearest the wet paper web contact side 11, but separated from the other knitted layer by a fibrous assembly 30.

Figure 5:
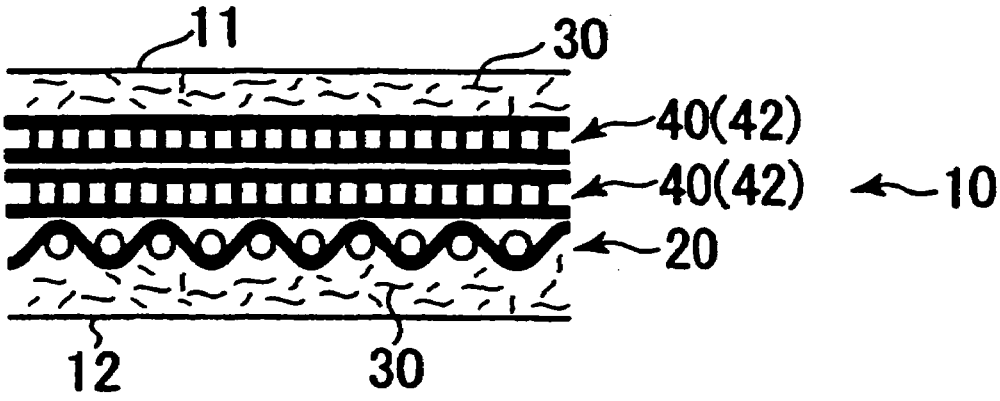
FIG. 5 is a schematic sectional view illustrating the distribution and formation of a three-dimensional knitted fabric of a felt according to the invention.

As a further alternative, a plurality of layers of three-dimensional knitted fabric may be provided between a base body and a wet paper web contact surface 11 as shown in FIG. 5, or, although not illustrated, between the base body and the machine contact surface. In these cases the layers of three-dimensional knitted fabric may be in contact with, or separated from the base body, and may be in contact with, or separated from one another.

When a layer of three-dimensional knitted fabric is formed on the machine contact surface side of the base body, some problems arise, and countermeasures may be taken. For example, where a grooved roll contacts the machine contact surface of the felt abrasion of the machine contact surface may occur. It is important to avoid exposure or breaking of the layer of three-dimensional knitted fabric as a result by abrasion, and this may be achieved by incorporating an increased amount of fiber in the fibrous assembly on the machine contact side.

On the other hand, when the layer 40 of the three-dimensional knitted fabric is provided on the wet paper web contact surface side 11, the problem of damage to the three-dimensional knitted fabric does not arise. Accordingly, in this respect, the last-mentioned structure is preferable. However, in this case, there is a concern that the pattern of the three-dimensional knitted fabric 42 might be transferred to the wet paper web. Therefore, when the layer of three-dimensional knitted fabric is provided on the wet paper web contact side of the base body, an increased amount of fiber in the fibrous assembly forming the wet paper web contact side may be used. Alternatively a shorter stitch length may be used in the fabrics of the three-dimensional knitted structure. Preferably, the opening ratio of the surface of the fabric is 50% or less, and the size of the openings surrounded by fibers is 0.03 $cm^2$ or less.

It is preferable that base bodies 20 be provided both on the machine contact surface side 12 of the three-dimensional knitted fabric layer 40 and on the wet paper web contact surface side 11, as shown in FIGS. 3(*a*)–3(*d*). In these structures, the friction problem on the machine contact surface side 12 and the transfer problem on the wet paper web contact surface side 11 are less likely to cause problems.

It is also generally preferable to provide a fibrous assembly 30 between the layer 40 of three-dimensional knitted fabric and the base body 20. The three-dimensional knitted fabric and the base body are connected tightly by the fibrous assembly, and as a result, the felt exhibits greater strength, compared to that of the felt in which the fibrous assembly is not provided between the base body and the three-dimensional knitted fabric.

For the base body 20, which imparts strength to the felt, various structures may be adopted. For example, the base body may be composed of a cloth woven from machine direction and cross-machine direction threads, a structure formed by piling machine direction threads and cross-machine direction threads instead of weaving them, or a structure formed by winding a cloth.

The fibrous assembly 30 is an assembly of staple fibers. The staple fibers may be accumulated on the base body 20, or on the layer 40 of three-dimensional knitted fabric, using a curding apparatus, and may be intertwiningly integrated with the base body or knitted fabric by needle punching. It is also possible to place a non-woven fabric, comprising an assembly of staple fiber which are intertwiningly integrated by needle punching, on the base body 20 or on the layer 40 of the three-dimensional knitted fabric. The non-woven fabric may then be intertwiningly integrated with the base body 20 or the layer 40 by needle punching.

The fibrous assembly 30 may also be bonded, by adhesive, to the base body 20 or the layer 40 of three-dimensional knitted fabric. However, it is preferable to integrate the fibrous assembly with the base body or with the knitted fabric by needle punching, for optimum strength of the connection.

Fibers enter into the three-dimensional knitted fabric when the fibrous assembly 30 is integrated with the three-dimensional knitted fabric 42 by needle punching. In this case, when too much fiber enters into the three-dimensional knitted fabric, compression recoverability and its sustainability, which are primarily due to the connecting fibers 48 of the three-dimensional knitted fabric decrease. Therefore, attention should be paid to the amount of fiber which enters into the three-dimensional knitted fabric. Preferably the density of the three-dimensional knitted fabric is in the range from 0.1 $g/cm^3$ to 0.4 $g/cm^3$, even when fiber has already entered into the three-dimensional knitted fabric.

In addition, care should be taken to avoid significant curving or bending of the connecting fibers 48 when the fibrous assembly 30 is integrated with the three-dimensional knitted fabric by needle punching.

A layer 40 of three-dimensional knitted fabric may be distributed and formed in the manufacturing process by winding a three-dimensional knitted fabric having ends until the wound fabric has the same width as the felt in which is to be incorporated.

Figure 12:
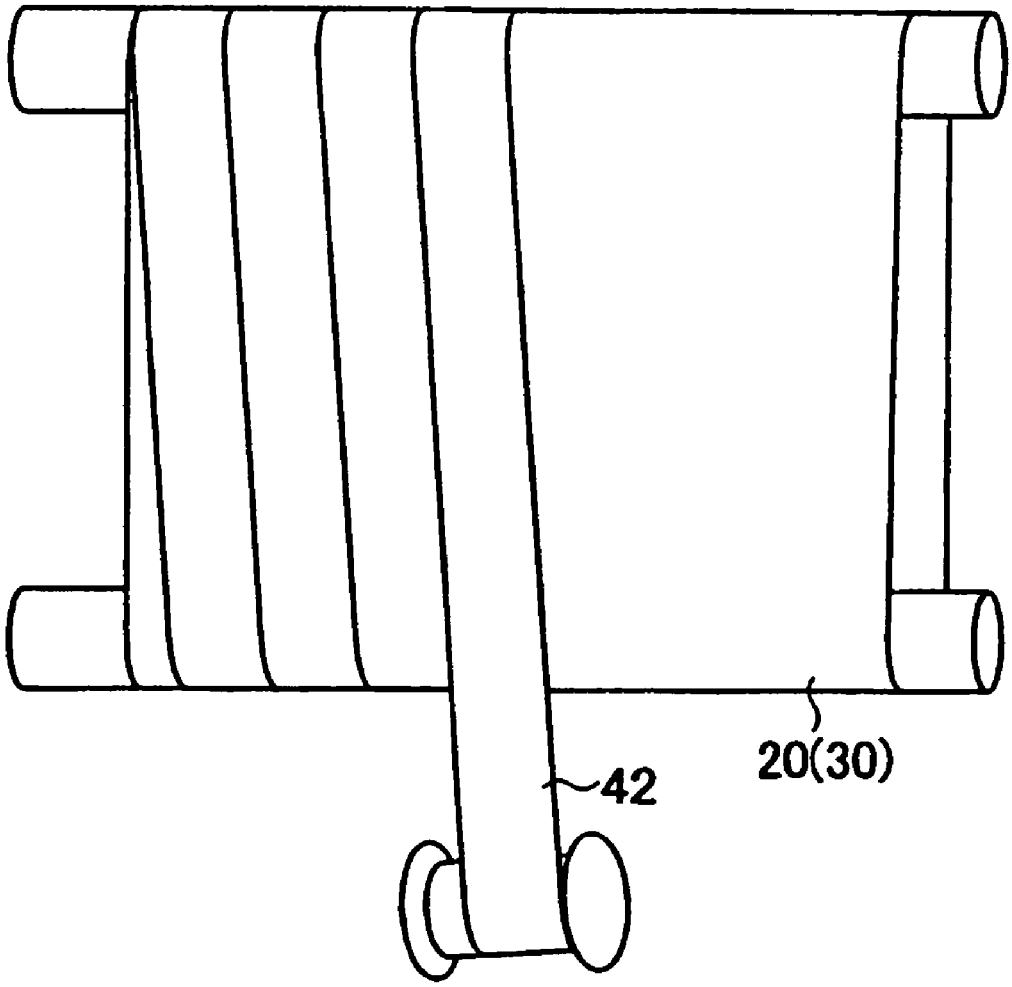
FIG. 12 PRIOR ART
FIG. 12 is schematic view illustrating a method of distributing a three-dimensional knitted fabric.

As shown in FIG. 12, a layer of a three-dimensional knitted fabric may be produced by winding a three-dimensional knitted fabric 42 in the shape of a helix onto an endless base body 20 or a fibrous assembly 30, stretched between two rolls, and connecting the adjacent turns of three-dimensional knitted fabric 42 to one another.

Figure 13:
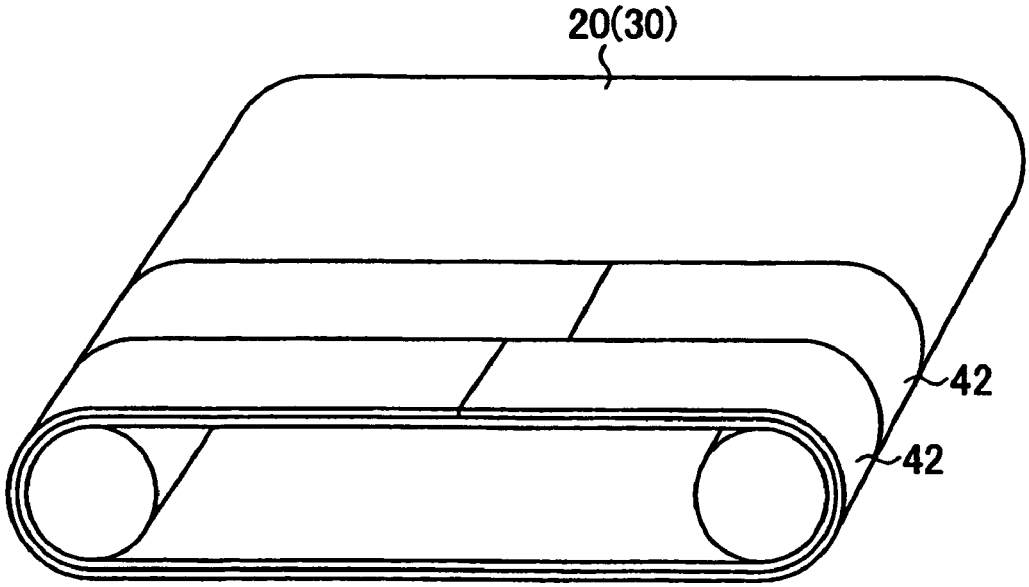
FIG. 13 PRIOR ART
FIG. 13 is a schematic view illustrating another method of distributing a three-dimensional knitted fabric.

Alternatively, as shown in FIG. 13, individual lengths 42 of three-dimensional knitted fabric may be dispoded in parallel, side-by-side, relationship to one another on an endless base body 20 or fibrous assembly 30.

After the three-dimensional knitted fabric is disposed on the base body or fibrous assembly as depicted in FIG. 12 or 13, it must be integrated with a fibrous assembly. On the other hand, a fibrous assembly 30 may be integrated with a three-dimensional knitted fabric 42 before the three-dimensional knitted fabric 42 is disposed on a base body 20. When this process is carried out, the combined knitted fabric and fibrous assembly may be placed on top of the base body, and the process of integrating another fibrous assembly 30 with the top of the combined knitted fabric, fibrous assembly and base body top of this complex can be simplified, or even omitted, depending on the particular felt structure which is to be produced.

Examples of the invention will now be described with reference to FIG. 14(*a*)–FIG. 16.

Figure 14:
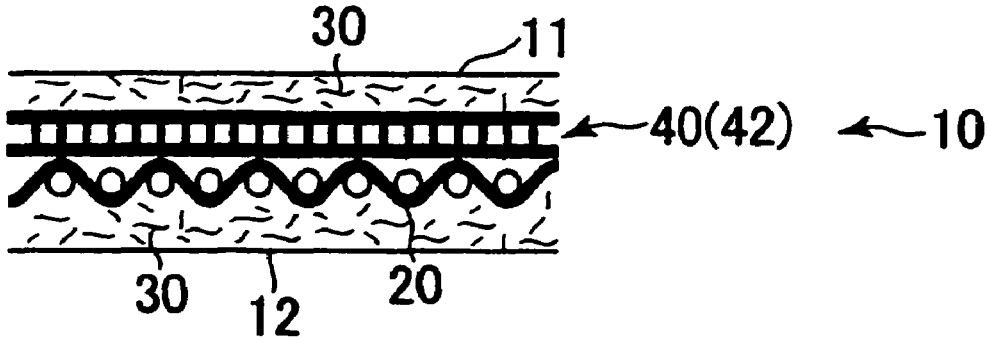
FIGS. 14(*a*)–14(*c*) are cross-sectional views of examples of the invention, and FIGS. 14(*d*) and 14(*e*) are cross-sectional views of comparative examples.
Figure 14:
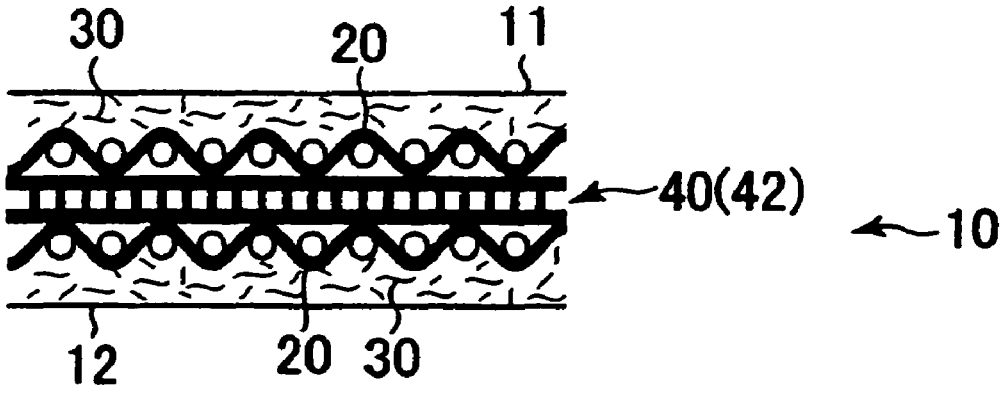
Figure 14:
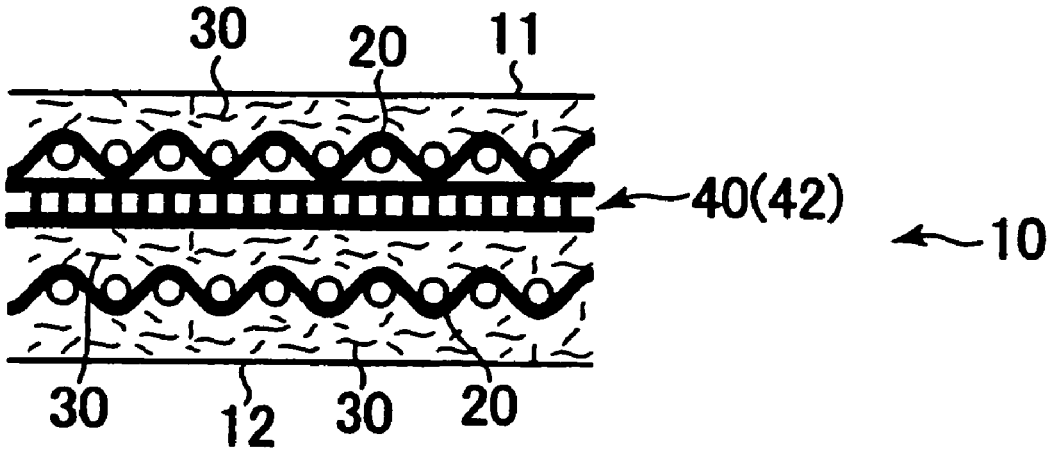
Figure 14:
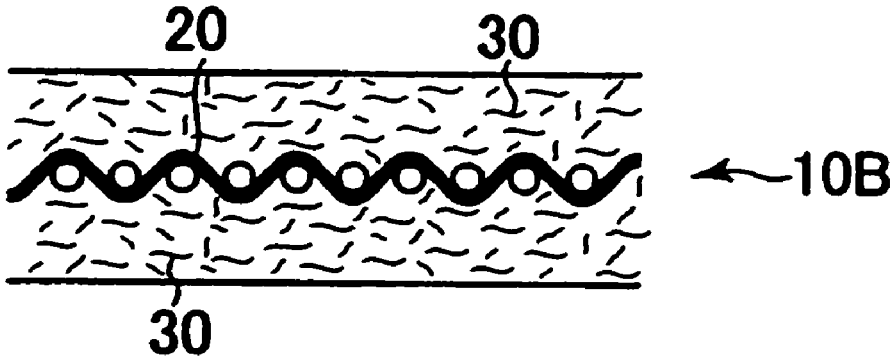
Figure 14:
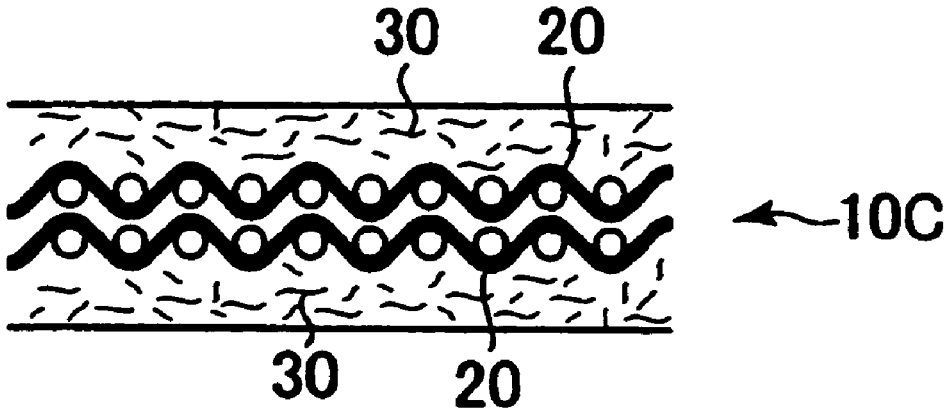

In FIG. 14(*a*) which shows a first example of a felt in accordance with the invention in cross-section, the felt 10 comprises a base body 20 composed of a woven fabric woven from machine direction and cross machine direction threads, a layer 40 of a three-dimensional knitted fabric in contact with and connected to the base body 20, and a fibrous assembly 30 intertwiningly integrated by needle punching with the base body 20 and the layer 40 of three-dimensional knitted fabric.

In each the second and third examples, illustrated respectively in FIGS. 14(*b*) and 14(*c*), the felt 10 comprises two base bodies 20, a layer 40 of a three-dimensional knitted fabric between the two base bodies 20, and a fibrous assembly 30 intertwiningly integrated by needle punching with the base body 20 and the layer 40 of three-dimensional knitted fabric.

In the second example, shown in FIG. 14(*b*), the base bodies 20 are respectively in direct contact with the three-dimensional knitted fabric on the wet paper web contact surface side and on the machine contact surface side.

On the other hand, in the third example, as shown in FIG. 14(*c*), one of the base bodies 20 is in direct contact with the three-dimensional knitted fabric on the wet paper web side thereof, but a fibrous assembly 30 is provided between the other base body and the knitted fabric on the machine contact side.

In the first comparative example, illustrated in FIG. 14(*d*), a widely used conventional felt 10B is comprises a base body 20, and a fibrous assembly 30 intertwiningly integrated with both sides of the base body 20 by needle punching.

In the second comparative example, shown in FIG. 14(*e*) a felt 10C comprises two base fabrics 20 and a fibrous assembly 30 integrated with both sides of the base bodies 20 by needle punching. In addition, the base fabrics are integrated by needle punching.

In order to standardize the conditions for the five examples, the basis weight (in g/m$^2$) of all the felts 10, 10B and 10C were made equal. The three-dimensional knitted fabrics 42 in the three examples of the invention were identical. In addition, the total basis weights of the fibrous assemblies in the felts were also made equal. All the base bodies 20 used in the second and third examples FIGS. 14(*b*) and 14(*c*)) were identical, and the basis weight of each of the base bodes 20 in the second and third examples was half the basis weight of the base body 20 used in the first example (FIG. 14(*a*)).

In the felt 10B in the first comparative example, the basis weight was made equal to that of the examples of the invention by making the basis weight of the fibrous assembly 30 correspond to that of the three-dimensional knitted fabrics in the examples of the invention.

In the felt 10C of the second comparative example, the basis weight was made equal to that of the examples of the invention by adjusting the basis weight of the base bodies 20 and the fibrous assembly 30.

In addition, in the first example of the invention, and in the second comparative Example 2, an identical structure was used for the staple fiber comprising the base body 20 and the fibrous assembly 30.

Figure 15:
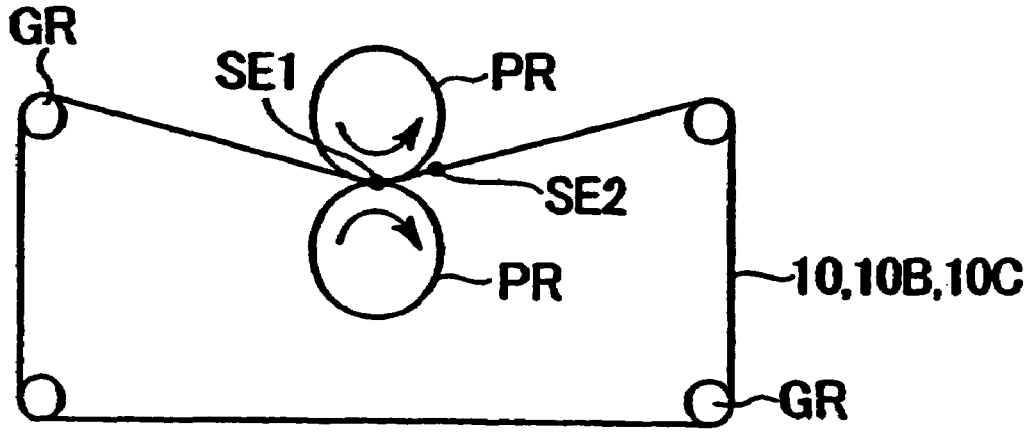
FIG. 15 is a schematic view of an apparatus for evaluating the compression recoverability and sustainability of a felt.
Figure 17:
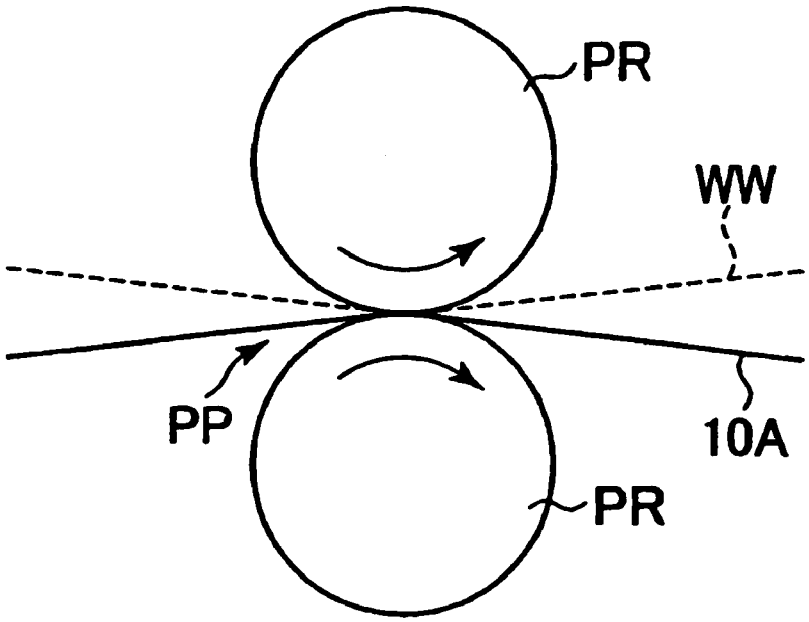
FIG. 17 PRIOR ART
FIGS. 17, 18 and 19 are schematic view of the press parts of three different papermaking machines.
Figure 18:
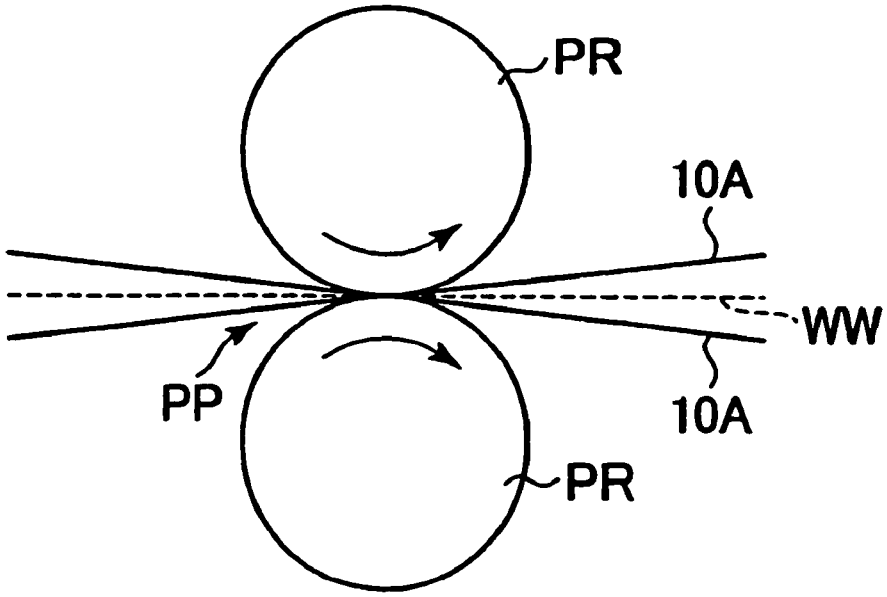
FIG. 18 PRIOR ART
Figure 19:
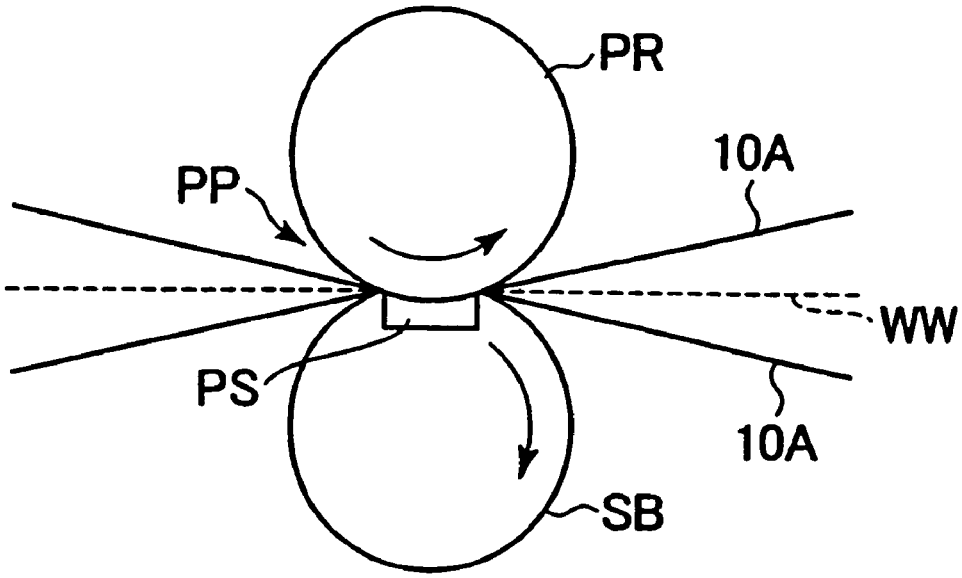
FIG. 19 PRIOR ART
Figure 20:
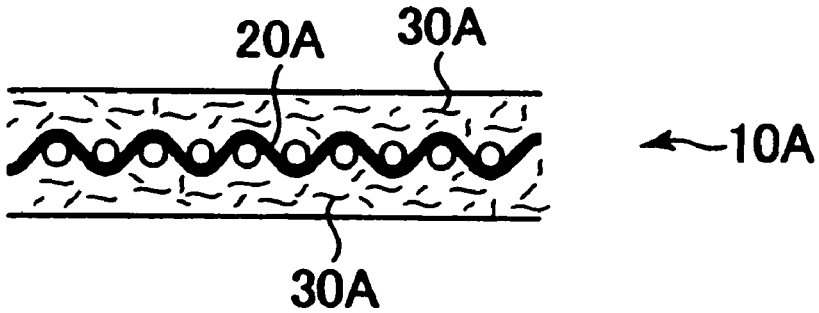
FIG. 20 PRIOR ART
FIGS. 20 and 21 are cross-sectional views of conventional felts
Figure 21:
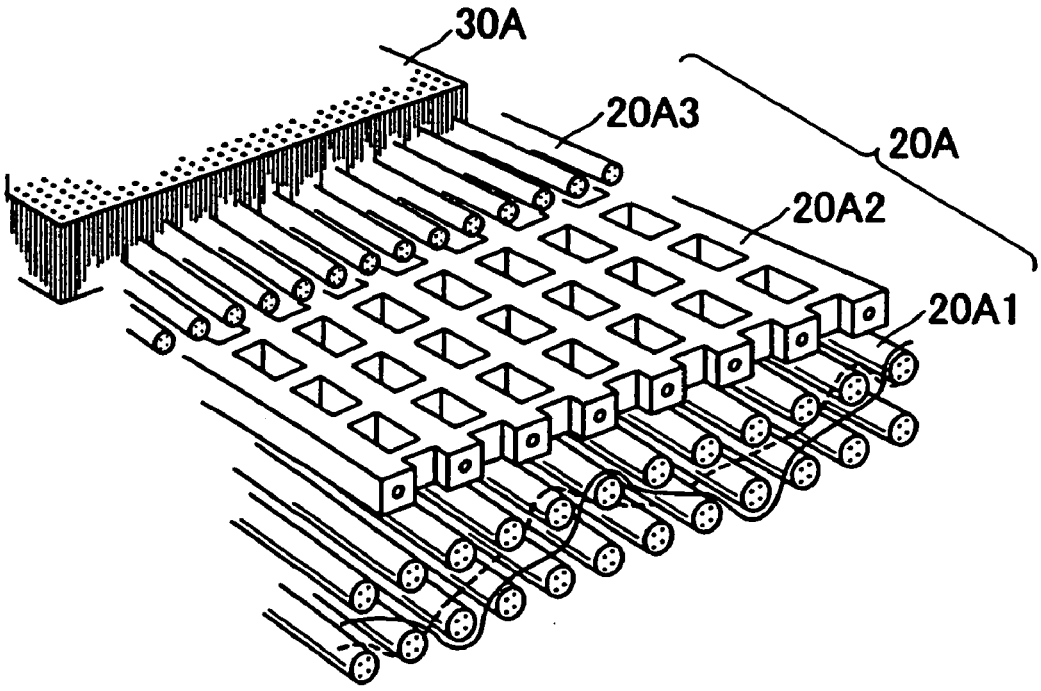
FIG.21 PRIOR ART

Compression recoverability and sustainability of the felts of the three examples of the invention and the two comparative examples were compared in an experiment using a test apparatus as shown in FIG. 15. The test apparatus of FIG. 15 has a pair of press rolls PR, guide roll GR supporting the felt and applying constant tension to it, a first sensor SE1, measuring thickness of the felt under direct pressure exerted by the pair of the press rolls PR, and a second sensor SE2, measuring thickness of the felt mediately after release of the pressure exerted by the press rolls.

The upper press roll PR rotates and exerts pressure the lower press roll PR. The felts 10, 10B, and 10C are supported by the guide rolls GR and are driven by rotation of the press rolls.

The test apparatus was operated at a press pressure of 100 kg/cm and a felt driving speed of 1000 m/minute, and the experiment was continued for 120 hours.

In addition, compression recoverability of the felts of the examples and the comparative examples was calculated by the formula (t2 –t1)/t1*100 where t1 presents the thickness (in mm) of a felt under nip pressure as determined by sensor SE1, and t2 represents the thickness (in mm) of a felt immediately after release of the nip pressure, as determined by sensor SE2.

Compression recoverability was calculated by substituting numerical values, measured in the experiment, into the above formula. These numerical values were measured both at a time right after the beginning of the experiment and at the time when the experiment ended.

A rating of 3 was assigned as the numerical value of compression recoverability for the first comparative example at the time right after the beginning of the experiment. In addition, with this rating 3 as a standard, if the measured value was higher than 3 the performance was evaluated as good; the higher the value was, the better the rating was. On the other hand, if the value was lower than 3, performance was evaluated as poor; the lower the numerical value was, the worse the rating was.

Sustainability was evaluated by retention of the density of the felt during the experiment and retention of compression recoverability. Here again, a rating of 3 was assigned as the numerical value for the first comparative example. With the rating of 3 as a standard, if the value was higher than 3, sustainability was evaluated as good; the higher the value was, the better the rating was. On the other hand, if the value was lower than 3, it was rated as poor; the lower the numerical value was, the worse the rating was.

A second experiment was conducted to measure the influence of a break on a wet paper web. This experiment was conducted, using the same test apparatus, and the felts which underwent the first experiment for 120 hours. This second experiment was conducted by putting a thin wet paper web (having a basis weight of 40 g/m$^2$) through the press part of the test apparatus and visually inspecting the wet paper web collected after pressing.

The wet paper web for the experiments was made by an oriented papermaking machine from Kumagai Riki Kogyo Co., Ltd.

An appraisal of ○ (excellent) was assigned to wet paper webs in which no breaks nor wrinkles were seen. compared to this, an appraisal of Δ (somewhat poor) was assigned to wet paper webs in which wrinkles were seen, and an appraisal of X (poor) was assigned to wet paper webs in which breaks were seen.

This examination was conducted under conditions in which a wet paper web may be easily damaged, and was conducted for the purpose of measuring the operation and working effect of the invention.

As a third experiment, an adhesion test was conducted to evaluate adhesion of a base body 20 and a three-dimensional knitted fabric 42. This experiment was conducted on the five examples using an Instron-type tensile strength tester. The adhesion between the two base bodies 20 in the second comparative example was assigned a rating of 3, and with this rating as a standard, a higher value corresponded to a more favorable rating for adhesion and a lower value corresponded to a less favorable rating for adhesion.

The results of the experiments are tabulated in FIG. 16.

It was determined from the results of the first experiment that the first comparative example was superior in early compression recoverability, but inferior in compression recoverability after repeatedly-applied pressure and also superior in its sustainability against repeatedly-applied pressure.

The second comparative example was inferior in early compression recoverability, but superior in sustainability against repeatedly-applied pressure.

On the other hand, it was determined that the three examples of the invention were able to maintain compression recoverability at high level and were superior in their stainability against repeatedly-applied pressure. In addition, it was determined that the felt of the first example was superior in compression recoverability, and that the felts of the second and third examples were superior in sustainability. It is assumed that the superior compression recoverability of the felt of the first example is due to the fact that the percentage the volume of the felt occupied by the three-dimensional knitted fabric is greater in the case of the felt of the first example.

No breakage of the wet paper web was observed in the second experiment for any of the examples. However, the felts in accordance with the invention achieved better ratings than the felts of the comparative examples.

In the third experiment, it was determined that the second example (FIG. 4(*b*)), in which both base bodies were in direct contact with the three-dimensional knitted fabric, was somewhat inferior in the strength of the connection between the base bodies and the knitted fabric. However all of the examples exhibited adhesion sufficient for practical use.

In summary, by providing, within the felt, a layer of a three-dimensional knitted fabric comprising two pieces of fabrics connected by connecting fibers, the invention produces highly beneficial effects by way of improved compression recoverability and sustainability.

What is claimed is:

1. A press felt for papermaking comprising a base body and a fibrous assembly, and having a wet paper web contacting surface and a machine contacting surface, and a three-dimensional knitted fabric comprising two overlying layers of fabric connected to each other by connecting fibers, said three-dimensional knitted fabric being incorporated within said press felt at a distance from both the wet paper web contacting surface and the machine contacting surface, wherein said three-dimensional knitted fabric is provided on the machine contacting surface side relative to said base body.

2. A press felt for papermaking as claimed in claim 1, wherein said connecting fibers are monofilament fibers.

3. A press felt for papermaking as claimed in claim 1, wherein said fibrous assembly is provided between said three-dimensional knitted fabric and said base body.

4. A press felt for papermaking as claimed in claim 2, wherein said fibrous assembly is provided between said three-dimensional knitted fabric and said base body.

5. A press felt according to claim 3, wherein said three-dimensional knitted fabric and said fibrous assembly are integrated by needle punching, the density of said three-dimensional knitted fabric being in the range from 0.1 g/cm$^3$ to 0.4 g/cm$^3$, with the fibers of said fibrous assembly having entered said three-dimensional knitted fabric as a result of needle punching.

6. A press felt according to claim 4, wherein said three-dimensional knitted fabric and said fibrous assembly are integrated by needle punching, the density of said three-dimensional knitted fabric being in the range from 0.1 g/cm$^3$ to 0.4 g/cm$^3$, with the fibers of said fibrous assembly having entered said three-dimensional knitted fabric as a result of needle punching.

7. A press felt for papermaking comprising a base body and a fibrous assembly, and having a wet paper web contacting surface and a machine contacting surface, and at leash two three-dimensional knitted fabrics, each three-dimensional knitted fabric comprising two overlying knitted layers connected to each other by connecting fibers, said three-dimensional knitted fabrics being incorporated within said press felt at a distance from both the wet paper web contacting surface and the machine contacting surface, and said base body being provided between two of said three-dimensional knitted fabrics.

8. A press felt for papermaking as claimed in claim 7, wherein at least one of said three-dimensional knitted fabrics, located between the base body and the wet paper web contacting surface, has openings surrounded by fibers, the opening ratio of the surface of said at least one of said three-dimensional knitted fabrics is 50% or less, and the size of the openings surrounded by fibers is 0.03 cm$^2$ or less.

* * * * *